US005503539A

United States Patent [19]

Nakajima et al.

[11] Patent Number: 5,503,539

[45] Date of Patent: Apr. 2, 1996

[54] SCROLL TYPE COMPRESSOR HAVING A THRUST BEARING FOR THE DRIVE SHAFT

[75] Inventors: Nobuyuki Nakajima; Masakuni Ishikawa; Susumu Saito, all of Konan, Japan

[73] Assignee: Zexel Corporation, Tokyo, Japan

[21] Appl. No.: 260,990

[22] Filed: Jun. 16, 1994

[30] Foreign Application Priority Data

Jun. 17, 1993 [JP] Japan ..... 5-171101

[51] Int. Cl.[6] ..... F04C 18/04

[52] U.S. Cl. ..... 418/55.1

[58] Field of Search ..... 418/55.1, 55.6

[56] References Cited

U.S. PATENT DOCUMENTS 5,215,452 6/1993 Yamamura et al. ..... 418/55.6

FOREIGN PATENT DOCUMENTS 58-172485 10/1983 Japan ..... 418/55.1
3-149391 11/1989 Japan .

*Primary Examiner*—John J. Vrablik

*Attorney, Agent, or Firm*—Wenderoth, Lind & Ponack

[57] ABSTRACT

A scroll compressor reduces the load applied to the thrust bearing, to prevent a thrust bearing from seizing and to improve the service life of the thrust bearing. It comprises an electric motor that is provided within a high pressure space inside a sealed case with a stator fixed within the sealed case and a rotor fixed to a drive shaft. An oscillating shaft is decentered on and extends from the drive shaft. An oscillating scroll member has an insertion hole into which the oscillating shaft is inserted. A fixed scroll member forms a compression space by fitting into the oscillating scroll member, and a block secures the fixed scroll member inside the sealed case and clamps the oscillating scroll member so that it can oscillate freely between the block and the fixed scroll member. The thrust bearing is provided between the drive shaft and the block to hold the lower end of the drive shaft so that it can rotate freely. The internal diameter of the thrust bearing is approximately equal to the external diameter of the oscillating shaft. As a result, the sliding contact surface at the thrust bearing can be reduced to an absolute minimum so that friction at the thrust bearing is reduced, thereby achieving the aforementioned objectives of reducing the load applied to the thrust bearing, preventing the thrust bearing from seizing and improving the service life of the thrust bearing.

7 Claims, 3 Drawing Sheets

SCROLL TYPE COMPRESSOR HAVING A THRUST BEARING FOR THE DRIVE SHAFT

BACKGROUND OF THE INVENTION

1. Field of the Invention

The present invention relates to a scroll type compressor that changes the volumetric capacity of a compression space formed with a fixed scroll member and an oscillating scroll member to compress an on-board coolant.

2. Related Art

In scroll type compressors of the related art, in which a compression space is formed by a fixed scroll member and an oscillating scroll member and the oscillating scroll member makes an oscillating movement relative to the fixed scroll member, the lubrication and sealing of the two members at the sliding contact surface are crucial factors.

Accordingly, the scroll type compressor disclosed in Japanese Patent Unexamined Publication 3-149391, for example, includes a rotary displacement type oil pump in its structure, so that a sufficient quantity of oil can be reliably supplied to the bearings regardless of the flow rate of the lubricating oil supplied to the compression work space. With this, a large quantity of lubricating oil can be assured even when high loads are applied to the revolving drive bearing, eccentric bearing and the first main bearing.

However, in the above example, if, in order to achieve a reduction in the weight of the compressor and a reduction in cost, the fixed scroll member and oscillating scroll member are made of a material other than a material, such as aluminum, for example, a problem arises. Because of the high back pressure on the oscillating scroll member, it is pressed towards the fixed scroll member, and as a result, the sliding area where the oscillating scroll member and fixed scroll member are in contact with each other tends to seize. To eliminate this problem, a thrust bearing for the drive shaft (hereafter referred to as "thrust bearing") is provided to bear the load applied to the drive shaft.

However, when the load is large, the thrust bearing itself can seize and also, as the load is applied constantly, the service life of the thrust bearing is shortened.

SUMMARY OF THE INVENTION

The present invention provides a scroll type compressor in which the load on the thrust bearing is reduced, seizure of the thrust bearing for the drive shaft is prevented and the service life of the thrust bearing is extended.

In order to achieve these objectives, the present invention comprises an electric motor that is provided in a high pressure space within a sealed case with a stator that is fixed within the sealed case and a rotor that is secured to the drive shaft. An oscillating shaft is formed as a decentered extension of the drive shaft. An oscillating scroll member is provided with an insertion hole into which the oscillating shaft is fitted. A fixed scroll member fits by interlocking with the oscillating scroll member to form a compression space. A block that secures the fixed scroll member inside the sealed case and clamps the oscillating scroll member such that it can oscillate freely against the fixed scroll member. A thrust bearing is provided between the drive shaft and the block to seal off the high pressure side from the low pressure side, and the internal diameter of this thrust bearing is approximately the same as the external diameter of the oscillating shaft.

Consequently, since the internal diameter of the thrust bearing and the external diameter of the oscillating shaft are equal in the present invention, the sliding contact surface of the thrust bearing can be limited to the absolute required minimum, resulting in reduced friction at the thrust bearing. With the present invention, therefore, it is possible to reduce the load applied to the thrust bearing, prevent seizure of the thrust bearing and improve the service life of the thrust bearing.

DETAILED DESCRIPTION OF THE PREFERRED EMBODIMENT

Following is an explanation of the preferred embodiment with reference to the drawings.

Figure 1:
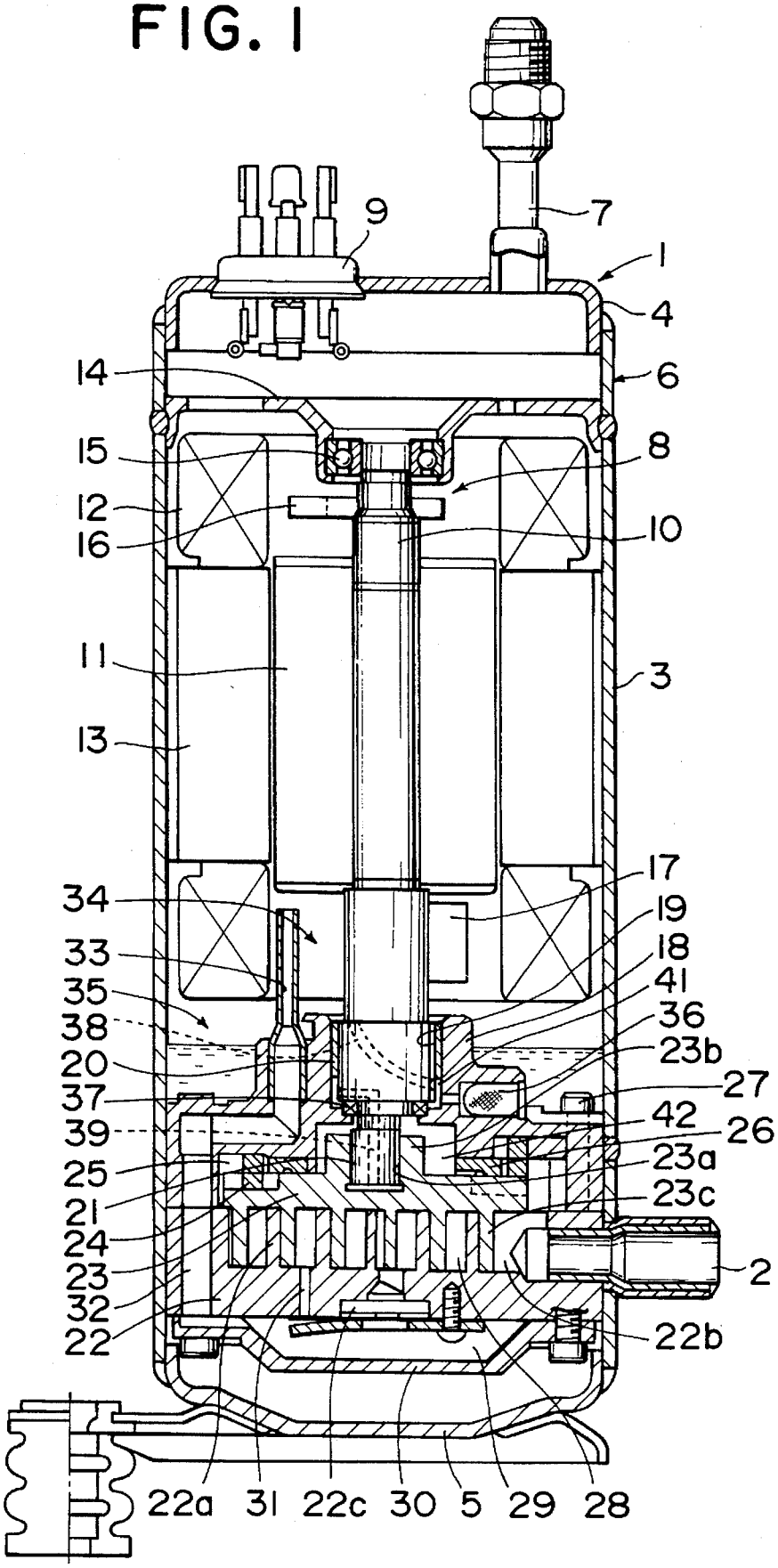
FIG. 1 is a cross section of a scroll type compressor in an embodiment of the present invention.

In a scroll type compressor 1 shown in FIG. 1, a sealed case 6 is structured with a cylindrical member 3 that is provided with a coolant intake port 2, a cap member 4 that seals the upper end of the cylindrical member 3, and a base member 5 that seals the lower end of the cylindrical member 3. Note that the cap member 4 is provided with a coolant outlet port 7 and a power supply terminal 9 for an electric motor 8.

The electric motor 8 may be, for example, a DC brushless motor provided with a drive shaft 10, a rotor 11 which is secured onto the drive shaft 10 and which is surrounded by a permanent magnet and a stator 13 which is secured onto the internal circumferential surface of the cylindrical member 3 and has a coil winding 12.

The drive shaft 10 is held by the drive shaft holding member 14 via the bearing 15 in such a manner that it can turn freely, and it is provided with an upper balance weight 16 near its upper end. The rotor 11 is secured below the upper balance weight 16. Below the rotor 11, a lower balance weight 17 is secured, and the lower portion of the balance weight 17 is inserted in a through hole 19 that is formed in a block 18, the details of which will be explained below. The lower portion of the drive shaft 10 is held by a main bearing 20 so that it can rotate freely. Projecting from the lower end of the drive shaft 10 is an oscillating shaft 21 that is provided off center of the drive shaft.

The block 18 is secured to the internal circumferential surface of the cylindrical member 3 and is provided with the through hole 19, which is formed by piercing the center of the block 18. A fixed scroll member 22, details of which will come later, is secured with a bolt 27 to the lower end surface of the block 18 and with this, an oscillating scroll member 23, also to be explained later, is clamped in such a manner that it can oscillate freely. Also, in order to hold the drive shaft 10, in addition to the main bearing 20, a thrust bearing 37 (hereafter referred to as "thrust bearing") for the drive shaft, to be explained later, is provided between the drive shaft 10 and the block 18. Note that the diameter of the lower section of the aforementioned through hole 19 is increased so that a projected portion 23*b* of the oscillating scroll member 23, where an insertion hole 23*a* is formed, can make its oscillating motion.

An oldham's-ring housing groove 25 is formed on the surface of the block 18 where the oscillating scroll member 23 slides for containing an oldham's-ring 24, which prevents the oscillating scroll member 23 from spinning while it oscillates. Also, on this sliding surface, a thrust bearing 26 is provided for the oscillating scroll and has a lubricating oil groove formed in it.

The oscillating scroll member 23 is provided with the projected portion 23*b* formed at the center of its upper surface and the insertion hole 23*a* is formed in the projected portion 23*b*, into which the oscillating shaft 21 is fitted. The oscillating scroll 23*c* is formed in a coil on the lower surface of the oscillating scroll member 23.

The fixed scroll member 22 is provided with a fixed scroll 22*a* which interlocks with the oscillating scroll 23*c* to form a compression space 28. An intake chamber 22*b* is provided on one side between the aforementioned coolant intake port 2 and the end of the compression space 28. A coolant outlet 22*c* is also provided, formed at the center of the lower end surface, which communicates with the last level of the compression space 28. A cover 30, which forms a coolant outlet passage 29, is secured onto the lower end surface of the fixed scroll member 22. Note that in the area of the middle level of the aforementioned compression space 28, a bypass channel 31 is provided, which communicates between the compression space 28 and the aforementioned coolant passage 29, and which is opened if the pressure inside the compression space 28 exceeds a specific value.

When the electric motor 8 is driven in the scroll type compressor 1, structured as described above, the oscillating scroll member 23 attached decentered to the drive shaft 10 of the electric motor 8, makes an oscillating motion relative to the fixed scroll member 22. The compression space 28, constituted by the oscillating scroll 23*c* and the fixed scroll 22*a*, gradually reduces in volumetric capacity from the intake side to the outlet side. With this, the coolant taken in through the coolant intake port 2 is compressed and then discharged from the coolant outlet channel 22*c* into the coolant outlet passage 29. Then it passes through the coolant conduit 32 which is a continuous passage through the fixed scroll member 22 and the block 18, and then passes through an extended pipe 33 mounted on the block 18 reaches a space (high pressure chamber) 34 where the aforementioned electric motor 8 is provided and is sent out via the coolant outlet port 7 to the next process in the cooling cycle.

Figure 2A:
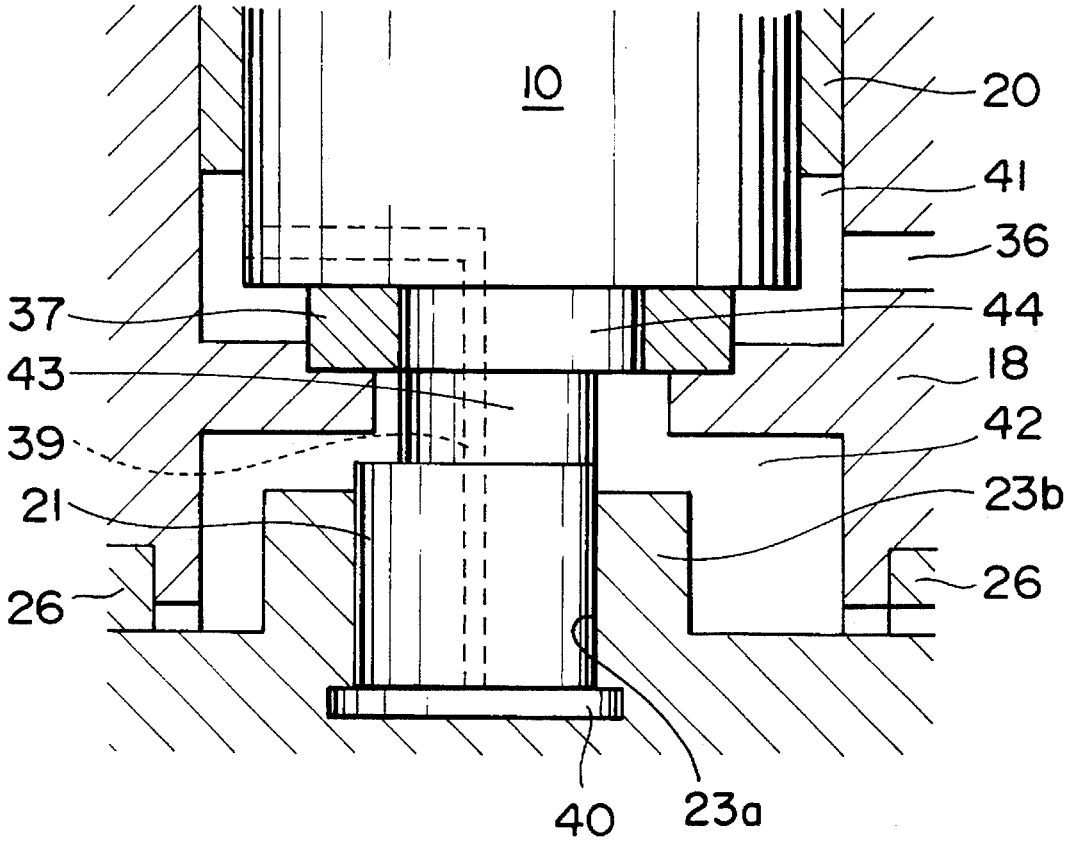
FIGS. 2A and 2B are an enlarged cross sections of a thrust bearing area of the scroll type compressor in the embodiment of the present invention.
Figure 2B:
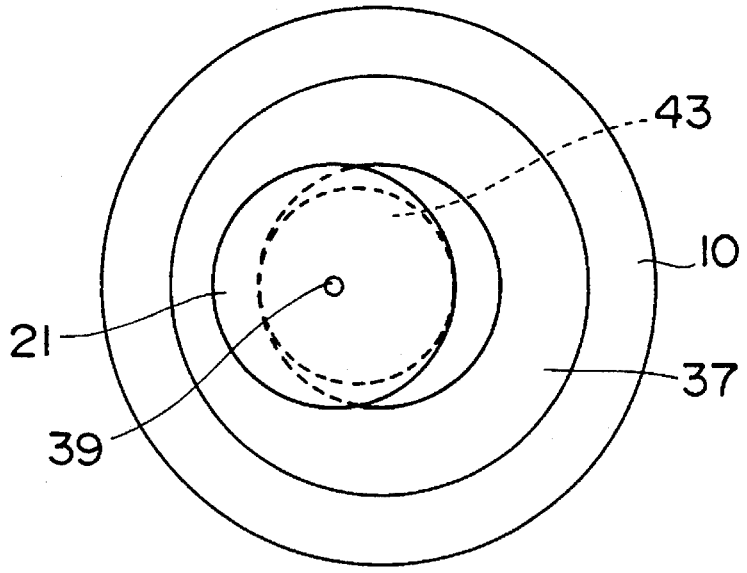

Also, in this high pressure chamber 34, the lubricating oil that has been separated by the rotation of the electric motor 8 is stored in the oil reservoir 35 that is formed over the block 18. The lubricating oil thus stored in the oil reservoir 35 flows from a lubricating oil intake port 36 shown in FIGS. 1 and 2A to the space 41 over the aforementioned thrust bearing 37 due to the difference in pressure between the high pressure chamber 34 and the low pressure on the intake side of the compression space 28.

The lubricating oil which flows into the space 41, while lubricating the main bearing 20, is divided to follow two different paths, one path passing oil up an oil supply groove 38 formed on an incline on the external circumferential surface of the drive shaft 10 to reach the upper end thereof, and the other path passing the oil supply through a hole 39 from the space 41 over the thrust bearing 37 to a space 40 formed by the end of the aforementioned oscillating shaft 21 and the insertion hole 23*a*. In the first passage, the lubricating oil flows out to the outside from the upper end of the oil supply groove 38 and returns to the oil reservoir 35.

In the second passage, because of the constricting effect of the clearance formed by the external circumferential surface of the aforementioned oscillating shaft 21 and the internal circumferential surface of the insertion hole 23*a*, the pressure in the space 40 is maintained at a high level. Also, in this second passage, the lubricating oil passes through the clearance and reaches the space 42 which is beneath the thrust bearing 37 while lubricating the sliding area of the external circumferential surface of the oscillating shaft 21 and the internal circumferential surface of the insertion hole 23*a*. From this space 42, it lubricates the oldham's-ring housing groove 25 and the oldham's-ring 24 itself, and then it reaches the intake chamber 22*b* formed at the fixed scroll member 22. From the intake chamber 22*b* the lubricating oil is carried along with the coolant into the compression chamber 28 where it lubricates and seals the compression chamber 28.

Figure 3A:
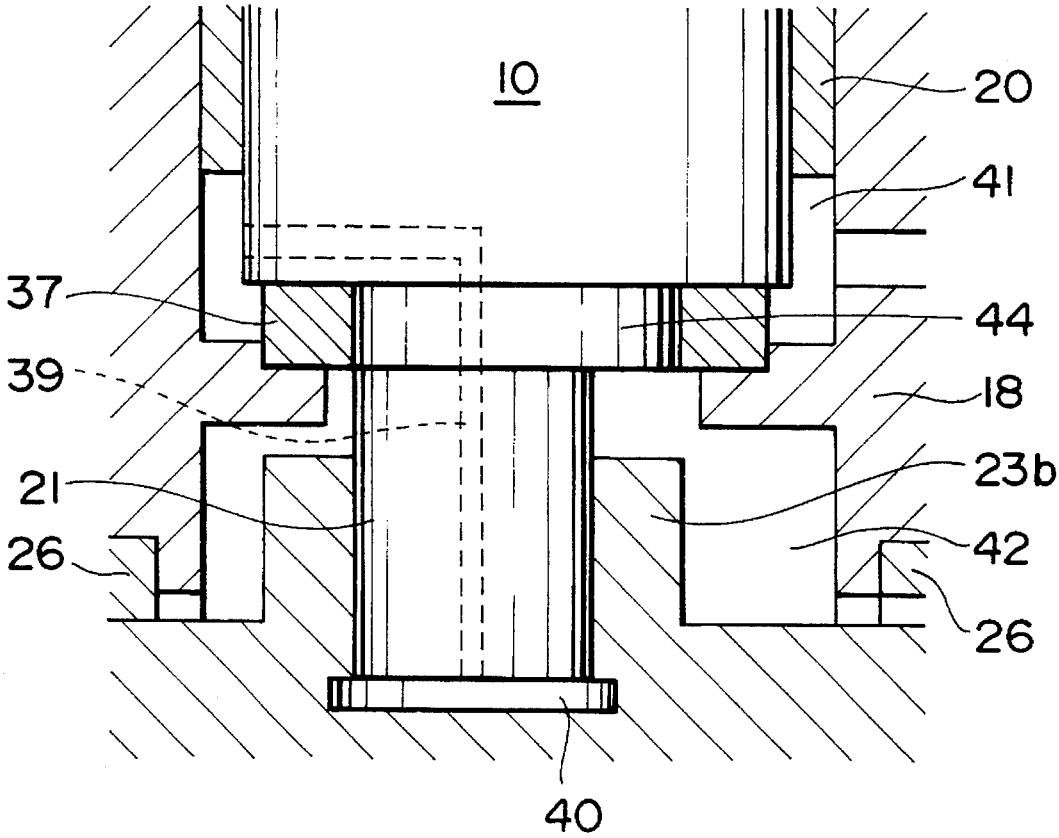
FIG. 3A PRIOR ART
FIGS. 3A and 3B are an enlarged cross sections of a thrust bearing area of a scroll type compressor of the prior art.
Figure 3B:
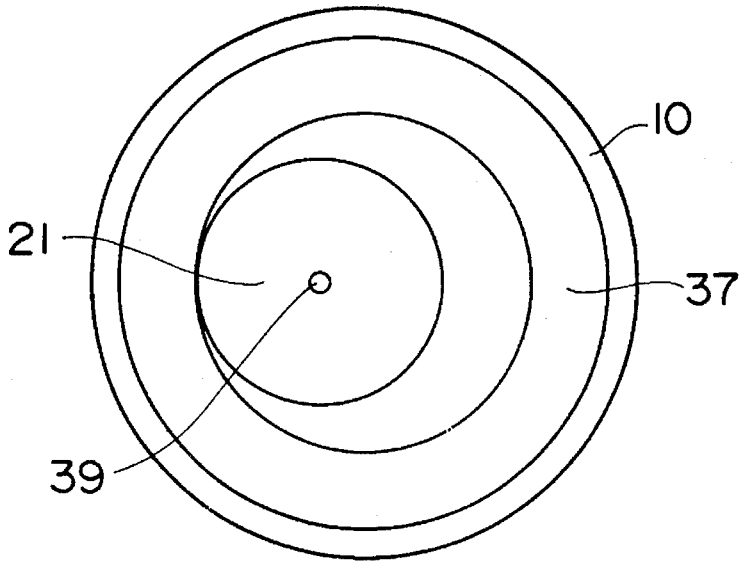
FIG. 3B PRIOR ART

In the prior art, the aforementioned thrust bearing 37, as shown in FIGS. 3A and 3B, is conventionally provided between the drive shaft 10 and block 18 to receive the thrust force described below and it is also provided in order to seal the gap between the space 41, which is at high pressure, and the space 42 where the pressure is low. In the prior art, the internal diameter of the thrust bearing 37 equals or is greater than the range in which the oscillating shaft 21 travels so that the oscillating shaft 21, which is decentered from the axis of the drive shaft 10, can make an oscillating motion.

However, the larger the internal diameter of the thrust bearing 37, the larger the area of sliding contact with the drive shaft 10 or the block 18 will be. This presents the problem of increasing friction due to increased sliding resistance. Also, as the high pressure and low pressure regions are separated from each other by the thrust bearing 37, the smaller the thrust bearing 37 is, the smaller the area at the end of drive shaft 10 that is in contact with the low pressure side will be, resulting in reduced thrust force applied to the drive shaft 10. In other words, for the internal diameter of the thrust bearing 37, the smaller the better.

However, when mounting the thrust bearing 37 on to a linking section 44, which is formed at the lower end of the drive shaft 10 where the oscillating shaft 21 is connected, it is necessary that the thrust bearing 37 encompass the outer circumferential area of the oscillating shaft 21. This means the internal diameter of the thrust bearing 37 cannot be made smaller than the external diameter of the oscillating shaft 21. Thus, it follows that the external diameter of the oscillating shaft 21 is made as small as possible. However, since the oscillating shaft 21 must withstand the load required to turn the oscillating scroll member 23, the diameter cannot be made smaller than a specific size.

Thus, in order to mount the thrust bearing 37, whose diameter is made equal to the external diameter of the oscillating shaft 21, on to the linking area 44, a small diameter section 43 (FIG. 2A), whose external diameter is smaller than the external diameter of the oscillating shaft 21 (that is the internal diameter of the thrust bearing 37) is formed between the linking section 44 and the oscillating shaft 21. Note that the width of this small diameter section 43 must be equal to or larger than the width of the thrust bearing 37. As the thrust bearing 37, which has passed the oscillating shaft 21, can travel towards the axis of the drive shaft, with the formation of this small diameter section 43, it can be mounted between the drive shaft 10 and the block 18 at a specific position, that is, at the external circumferential surface of the linking portion 44.

As has been explained, with the present invention, the sliding contact surface of the thrust bearing can be kept to a minimum by reducing the internal diameter of the thrust bearing to equal the external diameter of the oscillating shaft, resulting in reduced friction at the thrust bearing and reduced thrust load. Thus, it is possible to prevent seizure of the thrust bearing and to improve the durability of the thrust bearing.

What is claimed is:

1. A scroll compressor, comprising:

a sealed case having an electric motor provided in a high pressure space in said sealed case, said electric motor comprising a stator fixed within said sealed case and a rotor fixed to a drive shaft within said sealed case;

an oscillating shaft that is decentered on and extends from said drive shaft, said oscillating shaft having an external diameter;

an oscillating scroll member having an insertion hole therein, said oscillating shaft being fitted into said insertion hole;

a fixed scroll member engaged with said oscillating scroll member such that said fixed scroll member and said oscillating scroll member form a compression space therebetween;

a block that secures said fixed scroll member inside said sealed case and has said oscillating scroll member located between said fixed scroll member and said block such that said oscillating scroll member can oscillate freely between said block and said fixed scroll member; and a thrust bearing provided between said drive shaft and said block supporting one end of said drive shaft on said block such that said drive shaft can rotate freely, said thrust bearing having an internal diameter approximately equal to the external diameter of said oscillating shaft.

2. The scroll compressor of claim 1, wherein a linking portion is provided between the one end of said drive shaft and said oscillating shaft, said linking portion having a small diameter section with a diameter smaller than the diameter of said oscillating shaft for facilitating the mounting of said thrust bearing at a specific position.

3. The scroll compressor of claim 1, wherein a coolant intake port extends through said sealed casing and communicates with a low pressure portion of said compression space, a high pressure portion of said compression space communicates with said high pressure space, and a coolant outlet port extends through said casing and communicates with said high pressure space.

4. The scroll compressor of claim 3, wherein a power supply terminal for said electric motor is provided on said sealed casing.

5. The scroll compressor of claim 3, wherein a linking portion is provided between the one end of said drive shaft and said oscillating shaft, said linking portion having a small diameter section with a diameter smaller than the diameter of said oscillating shaft for facilitating the mounting of said thrust bearing at a specific position.

6. The scroll compressor of claim 1, wherein said internal diameter of said thrust bearing that is approximately equal to said external diameter of said oscillating shaft is no smaller than said external diameter of said oscillating shaft.

7. A scroll compressor, comprising:

a sealed case having an electric motor provided in a high pressure space in said sealed case, said electric motor comprising a stator fixed within said sealed case and a rotor fixed to a drive shaft within said sealed case;

an oscillating shaft that is decentered on and extends from said drive shaft, said oscillating shaft having an external diameter;

an oscillating scroll member having an insertion hole therein, said oscillating shaft being fitted into said insertion hole;

a fixed scroll member engaged with said oscillating scroll member such that said fixed scroll member and said oscillating scroll member form a compression space therebetween;

a block that secures said fixed scroll member inside said sealed case and has said oscillating scroll member located between said fixed scroll member and said block such that said oscillating scroll member can oscillate freely between said block and said fixed scroll member; and a thrust bearing provided between said drive shaft and said block supporting one end of said drive shaft on said block such that said drive shaft can rotate freely, said thrust bearing having an internal diameter equal to the external diameter of said oscillating shaft.

* * * * *